US010605213B2

(12) United States Patent
Peters et al.

(10) Patent No.: US 10,605,213 B2
(45) Date of Patent: Mar. 31, 2020

(54) NOZZLE COMBUSTION SHIELD AND SEALING MEMBER WITH IMPROVED HEAT TRANSFER CAPABILITIES

(71) Applicant: CUMMINS INC., Columbus, IN (US)

(72) Inventors: Lester L. Peters, Columbus, IN (US); David L. Buchanan, Westport, IN (US); Timothy P. Lutz, Zionsville, IN (US); David B. Snyder, Franklin, IN (US); Derek G. Weiler, North Vernon, IN (US); Clayton R. Westerfeld, Columbus, IN (US); Julie Anne Colin, Columbus, IN (US); Akintomide K. Akinola, Whiteland, IN (US); Joseph Eric Parlow, Columbus, IN (US); Steven J. Kolhouse, Columbus, IN (US)

(73) Assignee: Cummins Inc., Columbus, IN (US)

( * ) Notice: Subject to any disclaimer, the term of this patent is extended or adjusted under 35 U.S.C. 154(b) by 68 days.

(21) Appl. No.: 15/241,223

(22) Filed: Aug. 19, 2016

(65) Prior Publication Data

US 2017/0051713 A1 Feb. 23, 2017

Related U.S. Application Data

(60) Provisional application No. 62/208,203, filed on Aug. 21, 2015.

(51) Int. Cl.
*F02M 53/04* (2006.01)
*F02M 55/00* (2006.01)

(52) U.S. Cl.
CPC ..... *F02M 53/046* (2013.01); *F02M 53/043* (2013.01); *F02M 55/004* (2013.01)

(58) Field of Classification Search
CPC .. F02M 53/046; F02M 53/043; F02M 55/004; A61M 39/24; A61M 39/26; F01P 3/16
See application file for complete search history.

(56) References Cited

U.S. PATENT DOCUMENTS 2,777,431 A * 1/1957 Meurer ..... F02M 53/046 123/470
3,125,078 A * 3/1964 Reiners ..... F02F 1/242 123/468

(Continued)

FOREIGN PATENT DOCUMENTS

DE 3529769 2/1987
EP 0440674 8/1991

(Continued)

*Primary Examiner* — David Hamaoui
(74) *Attorney, Agent, or Firm* — Faegre Drinker Biddle & Reath LLP

(57) ABSTRACT

An injector combustion shield assembly comprising a bore configured to receive a fuel injector, the bore including a fluid opening in fluid communication with a fluid jacket and a fluid outlet positioned within an annular wall of the bore; and a valve positioned between the fluid jacket and the fluid opening and configured to selectively permit a fluid from the fluid jacket to enter the bore, the valve being movable between an open configuration to permit fluid flow from the fluid jacket into the bore via the fluid opening and a closed configuration to prevent fluid flow from the fluid jacket into the bore.

36 Claims, 12 Drawing Sheets

(56) References Cited

U.S. PATENT DOCUMENTS 3,315,652 A * 4/1967 Ries ..... F02F 1/14 123/41.31
3,334,617 A * 8/1967 Palkowsky ..... F02M 61/14 123/41.31
3,353,522 A * 11/1967 Ley ..... F01P 3/16 123/41.31
3,737,100 A * 6/1973 Dreisin ..... F02M 53/043 123/457
3,945,353 A * 3/1976 Dreisin ..... F01P 9/02 123/41.22
4,066,213 A * 1/1978 Stampe ..... F02M 61/14 123/470
4,261,513 A * 4/1981 Andrews ..... F02M 61/205 239/125
4,267,977 A * 5/1981 Stockner ..... F02M 57/02 239/132.3
4,284,037 A * 8/1981 Kasting ..... F01P 3/02 123/41.31
4,296,887 A 10/1981 Hofmann
4,492,201 A 1/1985 Radaelli
4,589,596 A 5/1986 Stumpp et al.
4,620,516 A 11/1986 Reum et al.
4,625,682 A * 12/1986 Dietrich ..... F01P 3/16 123/41.31
5,024,193 A * 6/1991 Graze, Jr. ..... F02D 41/0027 123/259
5,131,429 A * 7/1992 Nixon ..... F16L 37/407 137/329.3
5,191,867 A * 3/1993 Glassey ..... F02M 57/025 123/446
5,320,909 A 6/1994 Scharman et al.
5,345,913 A * 9/1994 Belshaw ..... F02M 57/02 123/470
5,697,342 A * 12/1997 Anderson ..... F02G 5/00 123/446
5,769,319 A * 6/1998 Yen ..... F02M 45/10 239/124
5,784,783 A * 7/1998 Carpenter ..... B25B 27/023 29/426.5
5,785,721 A 7/1998 Brooker
5,860,394 A * 1/1999 Saito ..... F02M 53/043 123/41.31
5,983,843 A * 11/1999 Suzuki ..... F01P 3/16 123/302
6,182,437 B1 2/2001 Prociw
6,196,195 B1 * 3/2001 Trutschel ..... F02M 53/04 123/41.31
6,267,307 B1 7/2001 Pontoppidan
6,279,516 B1 * 8/2001 Haugen ..... F02F 1/38 123/41.82 A
6,279,603 B1 * 8/2001 Czarnik ..... B01D 53/8625 123/472
6,481,421 B1 11/2002 Reiter
6,805,103 B1 * 10/2004 Sumida ..... F02M 61/14 123/470
7,028,918 B2 4/2006 Buchanan et al.
7,070,126 B2 7/2006 Shinogle
7,325,402 B2 2/2008 Parker et al.
7,331,535 B2 2/2008 Lambert et al.
7,383,794 B2 * 6/2008 Hlousek ..... F02M 47/027 123/41.33
7,770,548 B2 * 8/2010 Yamagata ..... F01P 3/16 123/41.74
8,230,838 B2 * 7/2012 Clark ..... F02F 1/242 123/470
8,434,457 B2 * 5/2013 Coldren ..... F02M 53/043 123/41.31
8,544,450 B2 * 10/2013 Megel ..... F02F 1/242 123/169 CA
8,960,156 B2 * 2/2015 Martinsson ..... B21D 53/84 123/470
9,080,540 B2 * 7/2015 Peters ..... F01P 3/16
D735,760 S * 8/2015 Arellano ..... D15/5
9,382,887 B2 * 7/2016 Clark ..... F02B 77/00
9,410,520 B2 * 8/2016 Franks ..... F02M 61/14
2001/0015601 A1 * 8/2001 Henkel ..... F01P 3/16 313/11.5
2002/0125339 A1 * 9/2002 Perr ..... F02M 45/04 239/96
2004/0103878 A1 * 6/2004 Satapathy ..... F01L 9/02 123/321
2005/0224601 A1 * 10/2005 Baker ..... F02D 19/0605 239/132.5
2007/0267076 A1 * 11/2007 Strauss ..... F16K 11/044 137/625.48
2008/0271713 A1 * 11/2008 Morris ..... F02M 61/14 123/470
2009/0235898 A1 * 9/2009 Short ..... F02M 53/046 123/470
2010/0038458 A1 * 2/2010 Bircann ..... F02M 51/0682 239/584
2012/0217323 A1 * 8/2012 Martinsson ..... B21D 53/84 239/533.2
2014/0305400 A1 * 10/2014 Berger ..... F01P 3/16 123/193.6
2015/0211410 A1 * 7/2015 Saville ..... F01P 3/16 123/41.52
2016/0215692 A1 * 7/2016 Warey ..... F01P 3/02
2016/0363094 A1 * 12/2016 Luft ..... F02F 1/242
2017/0096932 A1 * 4/2017 Chiera ..... F02B 19/18

FOREIGN PATENT DOCUMENTS

| | | |
|---|---|---|
| FR | 2925612 | 6/2009 |
| GB | 2487588 | 1/2012 |
| RU | 2105186 | 2/1998 |

* cited by examiner

NOZZLE COMBUSTION SHIELD AND SEALING MEMBER WITH IMPROVED HEAT TRANSFER CAPABILITIES

CROSS-REFERENCE TO RELATED APPLICATIONS

This application claims priority to U.S. Provisional Patent Application Ser. No. 62/208,203, filed Aug. 21, 2015, the disclosure of which is hereby expressly incorporated by reference herein in its entirety.

FIELD OF THE DISCLOSURE

The present disclosure generally relates to fuel injector seal assemblies for internal combustion engines and more particularly, to nozzle combustion shields and sealing members with improved heat transfer capabilities.

BACKGROUND OF THE DISCLOSURE

An internal combustion engine includes an engine body and engine components, such as a fuel injector, spark plug, and pressure sensor mounted on the engine body. The engine body also includes one or more engine coolant passages containing engine coolant in close proximity to the engine components. For example, engines often require a separate injector sleeve insert to separate coolant from the fuel injector. Many designs for injector sleeve insertion exist with varying degrees of robustness against coolant, fuel, and combustion gas, leaks, particularly at the end closest to the combustion event, i.e. the combustion chamber. The high local temperatures make elastomeric sealing a challenge. Also, high mechanical and thermal load cycling may create high stress at the sleeve/head seal interface. An internal combustion engine with a fuel injector may require a combustion seal to keep combustion gases in a combustion chamber of the engine from flowing into a passage surrounding the fuel injector. One challenge with such seals is that they may be inefficient at transporting or transferring heat away from a nozzle housing of the fuel injector, or if such seals transport heat away from a distal end of a nozzle element housing, the seals may have insufficient strength to resist yielding, which may ultimately permit leaks.

SUMMARY OF THE DISCLOSURE

According to one embodiment, the present disclosure provides a heat transfer assembly. The assembly comprises: a bore configured to receive a fuel injector, the bore including a fluid opening in fluid communication with a fluid jacket and a fluid outlet positioned within an annular wall of the bore; and a valve positioned between the fluid jacket and the fluid opening and configured to selectively permit a fluid from the fluid jacket to enter the bore, the valve being movable between an open configuration to permit fluid flow from the fluid jacket into the bore via the fluid opening and a closed configuration to prevent fluid flow from the fluid jacket into the bore.

According to another embodiment, the present disclosure provides a heat transfer assembly comprising: a bore configured to receive a fuel injector, the bore including: a first fluid opening in fluid communication with a first fluid jacket; a second fluid opening in fluid communication with a second fluid jacket; and a fluid outlet positioned within an annular wall of the bore; a first valve positioned between the first fluid jacket and the first fluid opening and configured to selectively permit fluid from the first fluid jacket to enter the bore; a second valve positioned between the second fluid jacket and the second fluid opening configured to selectively permit fluid from the second fluid jacket to enter the bore, the second valve being movable between an open configuration to permit fluid flow from the second fluid jacket into the bore via the second fluid opening and a closed configuration to prevent fluid flow from the second fluid jacket into the bore.

According to another embodiment, a method of manufacturing a heat transfer assembly is provided. The method comprises: placing a fuel injector within a bore; engaging the fuel injector with a first valve; and engaging the fuel injector with a second valve positioned between a fluid jacket and a fluid opening configured to selectively permit a fluid from the fluid jacket to enter the bore, the second valve being movable between an open configuration to permit fluid flow from the fluid jacket into the bore via the fluid opening and a closed configuration to prevent fluid flow from the fluid jacket into the bore.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION OF EMBODIMENTS

The embodiments disclosed herein are not intended to be exhaustive or to limit the disclosure to the precise forms disclosed in the following detailed description. Rather, the embodiments were chosen and described so that others skilled in the art may utilize their teachings.

Figure 1A:
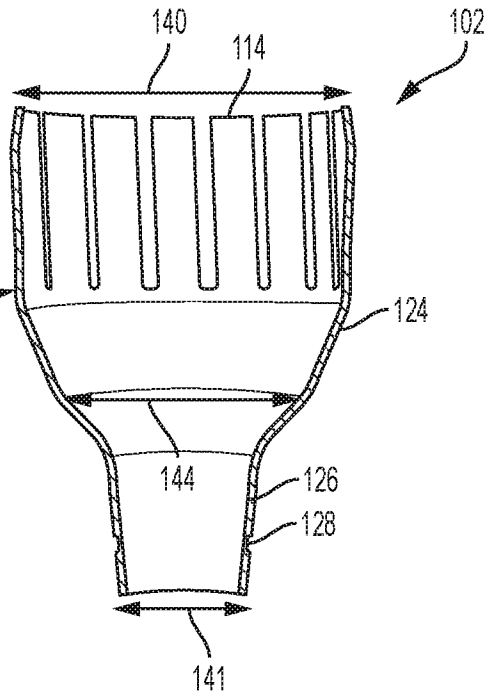
FIG. 1A shows a cross-sectional view of the injector combustion shield of FIG. 1 installed on the fuel injector of FIG. 1.
Figure 1:
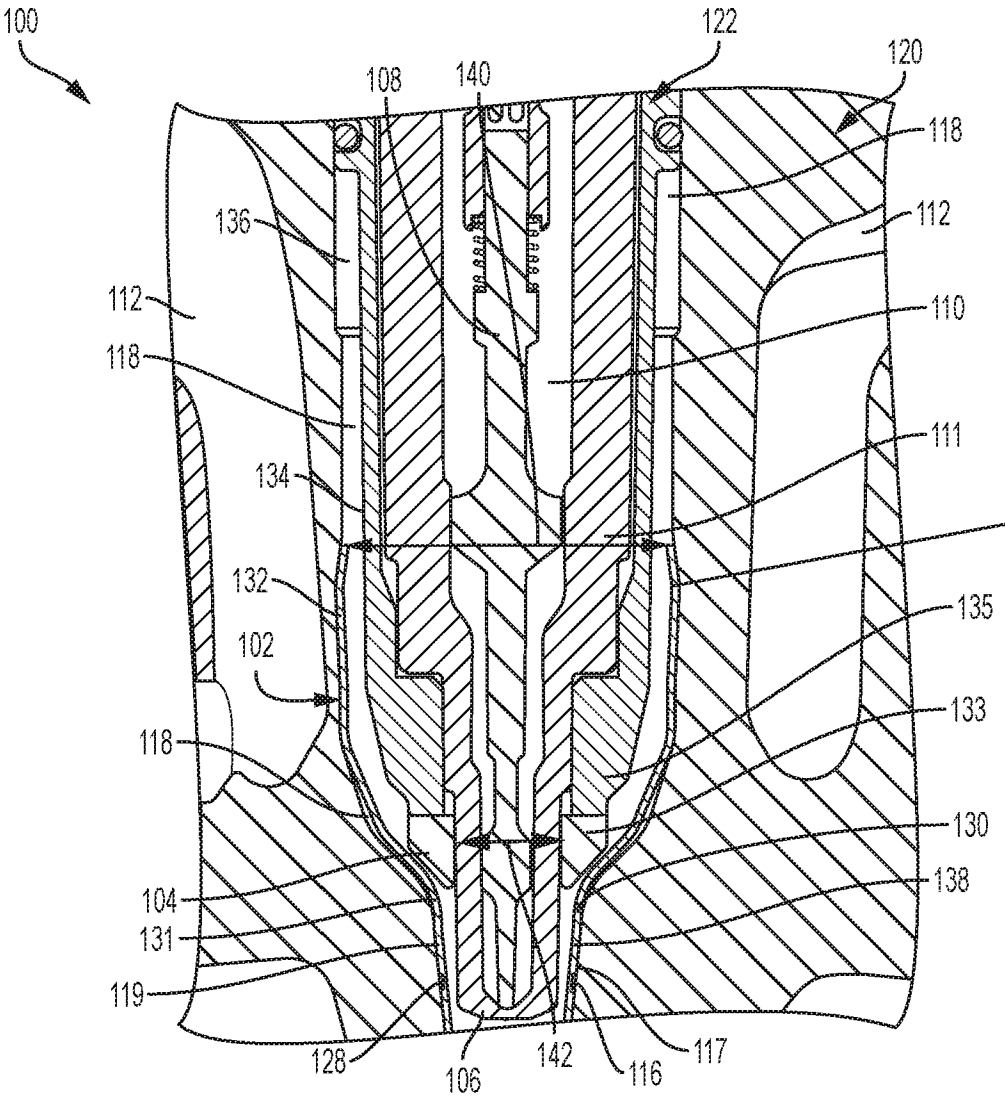
FIG. 1 shows a cross-sectional view of an injector combustion shield assembly installed on a fuel injector within an engine mounting bore.

Referring initially to FIGS. 1 and 1A, cross-sectional views of an injector combustion shield assembly 100 installed on a fuel injector 122 within an engine mounting/receiving bore 118 (hereinafter "bore 118") are shown. Fuel injector 122 generally includes nozzle 106, needle 108, fuel cavity 110, and injector body 111. In various embodiments of the present disclosure, fuel injector 122 may further include one or more components which are known by a person of ordinary skill in the art of fuel injector design and operation. In the illustrative embodiment of FIGS. 1 and 1A, injector combustion shield assembly 100 (hereinafter "assembly 100") generally includes combustion shield 102, first sealing member 104, and second sealing member 116. In one embodiment, shield 102 generally includes a first portion/section 124 and a second portion/section 126. First section 124 may include a plurality of fingers 114 structured to contact an annular exterior section/surface of fuel injector 122 as well as contact an inner annular wall of bore 118. Combustion shield 102 is generally structured to conduct heat from and/or adjacent to nozzle 106 longitudinally upwardly toward fingers 114 and ultimately toward the sections of bore 118 that are in contact with fingers 114 of shield 102. The heat adjacent nozzle 106 that is conducted by shield 102 results from combustion gases that are generated based on ignition and burning of atomized fuel injected by fuel injector 122 into a cylinder of an internal combustion engine.

Assembly 100 is dimensioned for positioning in bore 118 formed in an exemplary cylinder head of an engine body or head 120 of an internal combustion engine. In various embodiments and as discussed briefly above, bore 118 includes an interior annular wall/surface. Additionally, in these embodiments, injector 122 includes a peripheral exterior surface 134 that is adjacent to and in close proximity with the annular wall of bore 118 when fuel injector 122 is positioned in bore 118. The interior wall of bore 118 and exterior surface 134 of injector 122 forms an annular gap or passage 136 that extends radially between injector 122 and bore 118. In one embodiment, coolant, cooled water, or cooled low pressure fuel may be added within gap or passage 136 where the cooled fluid flows in contact with combustion shield 102 to absorb heat from shield 102 and facilitate cooling of nozzle 106. The use of such cooling fluid to reduce nozzle tip temperature is disclosed in U.S. Patent Application No. 62/204,254, filed Aug. 12, 2015, entitled "FUEL COOLED INJECTOR TIP" the entire disclosure of which being expressly incorporated herein by reference. In one embodiment, bore 118 may also include a nozzle receiving bore 117 structured for receiving an exemplary fuel injector nozzle such as nozzle 106 of fuel injector 122. Receiving bore 117 also includes an annular wall 119 and nozzle 106 includes a peripheral exterior surface 138 that is adjacent to and in close proximity with annular wall 119 when nozzle 106 is positioned in receiving bore 117. In the illustrative embodiment of FIGS. 1 and 1A, first section 124 of combustion shield 102 is positionable in bore 118 while second section 126 of shield 102 is positionable in receiving bore 117. In one embodiment, second portion 126 includes an annular groove 128 structured to receive second sealing member 116. In one embodiment, sealing member 116 may be an O-ring seal, a gasket seal, or any other equivalent sealing mechanism generally formed of a ring with a circular cross section and structured to provide a sealing interface.

As known by one of ordinary skill, engine head 120 may generally include one or more cylinders (not shown), and a piston (not shown) positioned for reciprocal movement in each cylinder. During longitudinal movement of the piston toward fuel injector 122, injector 122 injects fuel into a combustion chamber (not shown) formed by the portion of the cylinder that extends from the piston to the cylinder head. As injector 122 injects fuel into the combustion chamber and as the piston moves longitudinally toward fuel injector 122, combustion of the injected fuel occurs and heated combustion gases are produced in response to the combustion. In one embodiment, second sealing member 116 seals injector bore 118 and injector body 111 from the high temperature combustion gases that occur in response to ignition of the fuel injected by injector 122. In another embodiment, sealing member 104 also seals injector bore 118 and injector body 111 from the aforementioned high temperature combustion gases.

Assembly 100 is a thermally conductive or heat transfer assembly fabricated or formed of one or more materials having various degrees and/or ranges of thermal conductivity. In one embodiment, combustion shield 102 is fabricated from a Copper alloy material having a thermal conductivity of approximately 401 Watts per meter-Centigrade (W/m-C). In an alternate embodiment, combustion shield 102 is made from gray cast iron having a thermal conductivity of approximately 52 Watts per meter-Centigrade (W/m-C), steel having a thermal conductivity of approximately 42 Watts per meter-Centigrade (W/m-C) (e.g., H13 nozzle), or phosphor bronze having a thermal conductivity of approximately 40 Watts per meter-Centigrade (W/m-C) (e.g., phosphor bronze C51000). In one aspect of this embodiment, sealing member 104 is fabricated from a Stainless Steel material having a thermal conductivity of approximately 60.5 (W/m-C). The combined thermal conductivity of shield 102 and sealing member 104 cooperate to conduct or transfer combustion gas heat from the nozzle end of injector 122 up into low temperature sections of bore 118. Exemplary low temperature sections of bore 118 include the sections of bore 118 that are in contact with fingers 114 of combustion shield 102. In various embodiments of the present disclosure, engine head 120 may be part of an exemplary fluid/water-cooled internal combustion engine comprising one or more fluid/water jackets 112 having cooled fluid, water or low pressure fuel flowing throughout. Hence, as shown in the illustrative embodiment of FIGS. 1 and 1A, additional low temperature sections of bore 118 generally include portions of bore 118 that are in closest proximity to fluid jacket 112 such as bore low temperature section 132.

Sealing member 104 is designed and manufactured to carry a fuel injector clamp load to maintain structural integrity when clamped between fuel injector 122 and the annular wall of bore 118. Thus, assembly 100 beneficially combines combustion sealing with an enhanced ability to conduct, transfer, or wick heat away from nozzle 106 in order to maintain the reliability and sustained usability of fuel injector 122. Sealing member 104 is designed of a metal that is able to withstand the fuel injector clamp loads transmitted by injector 122 unto sealing member 104 and then unto the annular wall of bore 118. In one embodiment, combustion shield 102 is fabricated of a metal having a higher thermal conductivity than the material used to produce sealing member 104. Additionally, the contact between sealing member 104, combustion shield 102, fuel injector 122, and bore 118 is optimized to transfer heat from nozzle 106 of fuel injector 122 upwardly to a cooler portion of fuel injector 122.

In the illustrative embodiment of FIGS. 1 and 1A, sealing member 104 is positioned longitudinally between injector body 111 and an interior annular wall of combustion shield 102. Assembly 100 provides a metal to metal combustion seal with contact pressures high enough to yield sealing member 104 into sealing contact against the interior annular wall of combustion shield 102. In one embodiment, the contact pressure may be induced and maintained by the force from fuel injector 122 being mounted and secured within bore 118 by an exemplary fuel injector securement system. That is, the injector clamping or securing load for securing fuel injector 122 in bore 118 is generally relied upon to apply a sealing force to sealing member 104. In one embodiment, injector mounting bore 118 and combustion shield 102 cooperate to form a sealing interface/surface 130 positioned at an angle relative to needle 108 thereby providing a conical sealing surface. Sealing member 104 includes angled surface 131 that contacts sealing surface 130 when sealing member 104 is positioned longitudinally intermediate injector body 111 and combustion shield 102. Hence, the contact between sealing member 104 and surface 130 forms a fluid seal. In one embodiment, sealing member angled surface 131 and sealing interface 130 are each approximately at an angle of about 44 degrees with respect to needle 108.

Sealing member 104 is generally circular in shape and includes an interior ring diameter 142 formed by an annular interior ring wall portion and an angled exterior wall portion 133. In one embodiment, sealing member 104 may be formed of a single unitary piece. Although, in various alternative embodiments sealing member 104 may be formed of multiple pieces, a single unitary piece is easier to form and assemble as opposed to two or more pieces. As noted above, in one embodiment, sealing member 104 may be formed of a stainless steel material, which may be an SAE 303 stainless steel. In addition to the other benefits provided by sealing member 104, the material of sealing member 104 provides a thermal barrier to combustion heat from an exemplary combustion chamber. Sealing member 104 includes an end surface 135 that is sized and dimensioned to form a fluid seal with an end section of fuel injector 122. In one embodiment, end surface 135 is a flat planar surface that abuts or contacts an end section of fuel injector 122. This end section of injector 122 likewise has a flat, planar surface that mates with end surface 135 of sealing member 104.

In one embodiment of the present disclosure, combustion shield 102 is a component that is fabricated distinctly or formed separately from sealing member 104. As shown in the illustrative embodiment of FIGS. 1 and 1A, first section 124 generally has at least a first diameter 140 and second section 126 has a second diameter 141 that is smaller than first diameter 140. In one embodiment, combustion shield 102 may be formed of a single unitary piece. Although in various alternative embodiments combustion shield 102 may be formed of multiple pieces, a single unitary piece is easier to form and assemble as opposed to two or more pieces. In the embodiment of FIGS. 1 and 1A, combustion shield 102 is a conical load carrying copper heat transfer shield. The conical design allows combustion shield 102 to be received and secured within bore 118 such that sealing member 104 can cooperate with injector 122 to form a robust fluid seal and carry the clamping load induced by injector 122. In one embodiment, second section 126 of combustion shield 102 may provide retention onto nozzle 106 via, for example, a press fit that also allows heat to leave the combustion chamber and move upwardly longitudinally toward low temperature section 132. During installation of assembly 100 and fuel injector 122 into bore 118, when nozzle 106 is positioned within second section 126, an inner surface of second section 126 is directly adjacent to, mates with, abuts, or faces a peripheral outer surface of nozzle 106. In one embodiment, sealing member 104 may be slip-fit into an area of first section 124 having a diameter 144 that is less than diameter 140 but greater than diameter 141 of second section 126. Thus, because of the slip-fit installation, sealing member 104 is easily removable and replaceable during a fuel injector 122 service event.

Referring now to the illustrative embodiments of FIGS. 2-2B and FIG. 3, a cross-sectional view of an injector combustion shield assembly 200 (hereinafter "assembly 200") including perspective views of a combustion shield 202 and a first sealing member 204 are shown. In the illustrative embodiment of FIGS. 2-2B, although fuel injector 222 may differ slightly from fuel injector 122 in apparent design, descriptions of assembly 200 may include one or more elements of injector 222 and engine head 120 that are the same as described in the illustrative embodiment of FIGS. 1 and 1A and thus these elements will be numbered the same. As such, to the extent that additional descriptions are not provided, reference should be made to the above mentioned description of any elements of the embodiment of FIGS. 2-2B that are the same as the embodiment of FIGS. 1 and 1A.

Figure 2A:
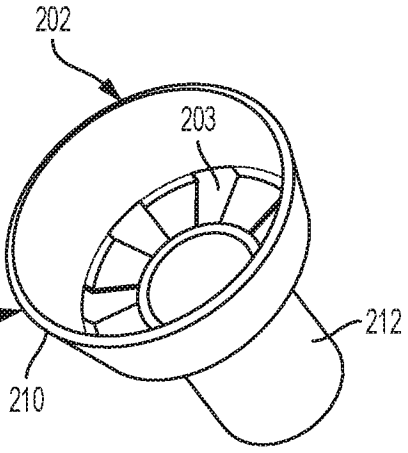
FIG. 2A shows a perspective view of the combustion shield of the injector combustion shield assembly of FIG. 2 according to an embodiment of the present disclosure.
Figure 2B:
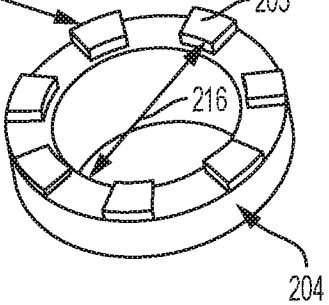
FIG. 2B shows a perspective view of the injector seal of the combustion shield assembly of FIG. 2 according to an embodiment of the present disclosure.
Figure 2:
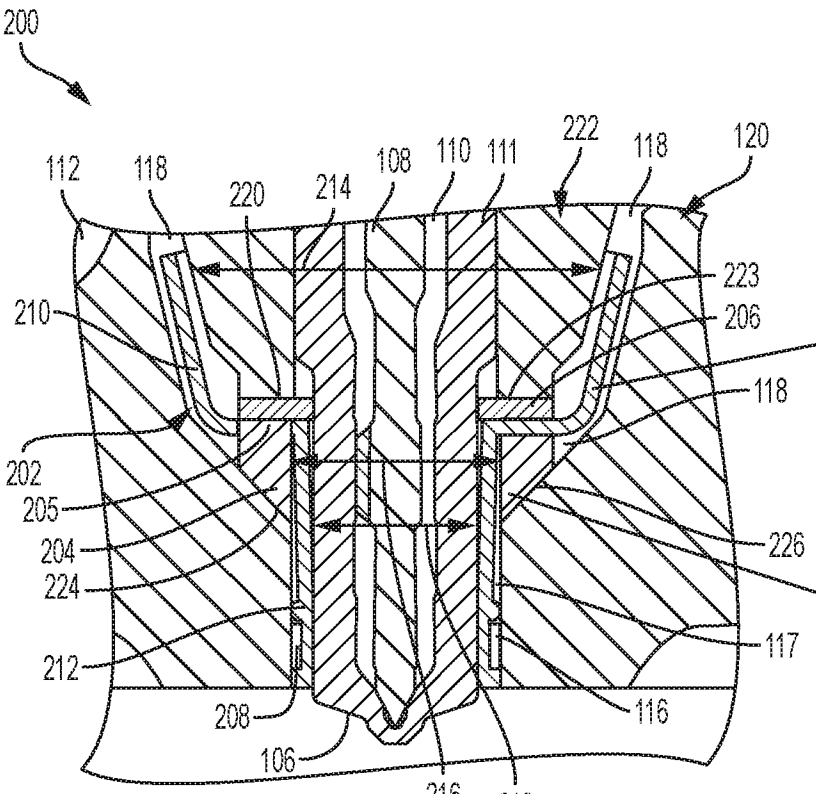
FIG. 2 shows a cross-sectional view of an injector combustion shield assembly including a combustion shield and injector seal according to an embodiment of the present disclosure.
Figure 3:
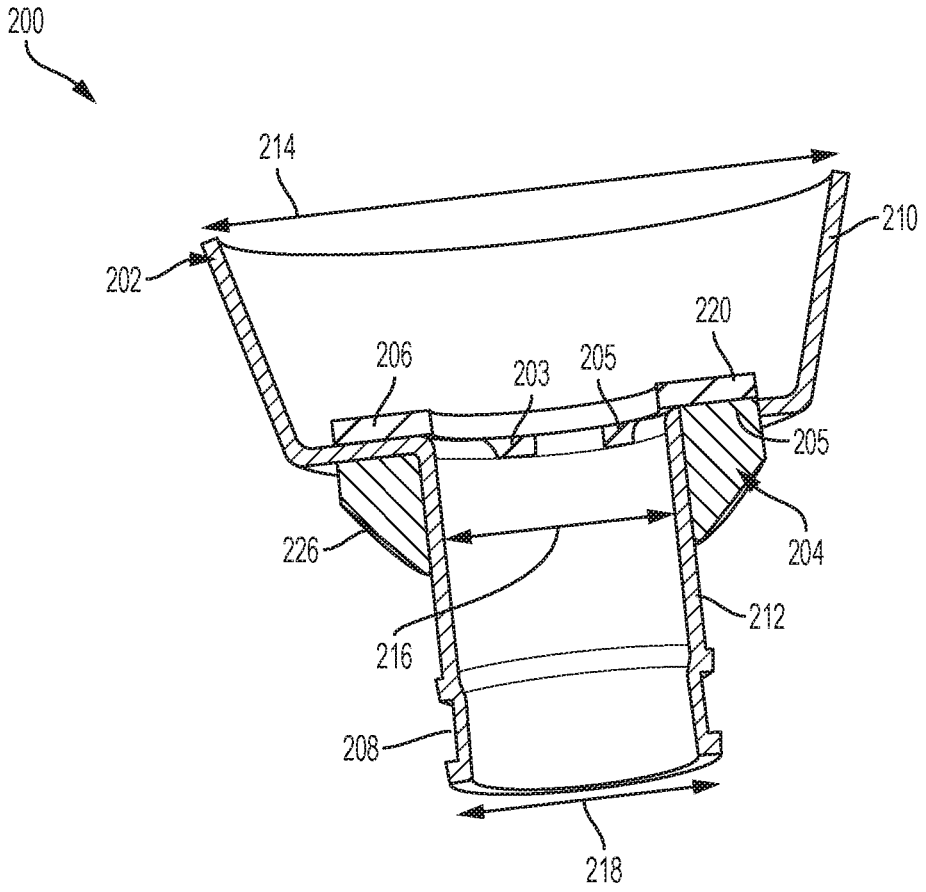
FIG. 3 is an enlarged cross-sectional view of the injector combustion shield assembly of FIG. 2.

In the illustrative embodiments of FIGS. 2-2B and FIG. 3, assembly 200 generally includes combustion shield 202, first sealing member 204, and second sealing member 116. In one embodiment, shield 202 generally includes a first portion/section 210 and a second portion/section 212. Sealing member 204 includes a plurality of raised members or portions 205 and first section 210 includes a plurality of slots or openings 203 wherein each slot/opening is structured to receive a single raised portion 205 of sealing member 204. First section 210 generally contacts an annular exterior section of fuel injector 222 as well as contacts an inner annular wall of bore 118. Much like combustion shield 102 of FIGS. 1 and 1A, combustion shield 202 is generally structured to conduct heat from and/or adjacent to nozzle 106 longitudinally upwardly toward first section 210 and ultimately toward the sections of bore 118 that are in contact with first section 210. As discussed above, the heat adjacent nozzle 106 that is conducted by shield 202 results from combustion gases that are generated based on ignition and burning of fuel injected by injector 222 into a cylinder of an internal combustion engine.

As shown in the illustrative embodiment of FIGS. 2-2B, assembly 200 is dimensioned for positioning in bore 118. First section 210 of combustion shield 202 is positionable in bore 118 while second section 212 is positionable in receiving bore 117. In one embodiment, second portion 212 includes an annular recess/groove 208 structured to receive a second sealing member 116. In one embodiment of the present disclosure, and as discussed above, second sealing member 116 seals injector bore 118 and injector body 111 from the high temperature combustion gases that occur in response to ignition of the fuel injected by injector 222. In another embodiment, sealing member 204 also seals injector bore 118 and injector body 111 from the aforementioned high temperature combustion gases. Assembly 200 is a thermally conductive or heat transfer component fabricated or formed of one or more materials having various degrees and/or ranges of thermal conductivity. In one embodiment, combustion shield 202 and sealing member 204 are fabricated from substantially the same materials as combustion shield 102 and sealing member 104. The combined thermal conductivity of shield 202 and sealing member 204 cooperate to conduct or transfer combustion gas heat from the nozzle end of injector 222 up into low temperature sections of bore 118. Exemplary low temperature sections of bore 118 include the sections of bore 118 that are in contact with first section 210 of combustion shield 202.

Much like sealing member 104, sealing member 204 is designed and manufactured to carry a fuel injector clamp load to maintain structural integrity when clamped between fuel injector 222 and the annular wall of bore 118. Thus, assembly 200 beneficially combines combustion sealing with an enhanced ability to conduct, transfer, or wick heat away from nozzle 106 in order to maintain the reliability and sustained usability of fuel injector 222. Sealing member 204 is designed of a metal that is able to withstand the fuel injector clamp loads transmitted by injector 222 unto sealing member 204 and then unto the annular wall of bore 118. In one embodiment, combustion shield 202 is fabricated of a metal having a higher thermal conductivity than the material used to produce sealing member 204. Additionally, the contact between sealing member 204, combustion shield 202, fuel injector 222, and bore 118 is optimized to transfer heat from nozzle 106 of fuel injector 222 upwardly to a cooler portion of fuel injector 222. In the illustrative embodiment of FIGS. 2-2B, sealing member 204 is positioned longitudinally and generally between injector body 111 and an interior annular wall of bore 118. Additionally, sealing member 204 is positioned longitudinally below first section 210, longitudinally above second section 212, and around a first end of second section 212. As discussed above, sealing member 204 includes plurality of raised portions 205 wherein each raised portion may be received by a single slot/opening 203 of first section 210. In one embodiment, sealing member 204 is coupled to or mates with combustion shield 202 by way of raised portions 205 being received by openings/slots 203 of first section 210. After mating/coupling, shield 202 and sealing member 204 may be fused together by way of, for example, furnace brazing to form a single unitary combustion shield and sealing component assembly.

In one embodiment, a third sealing member 206 may be positioned intermediate sealing member 204 and an end section 223 of fuel injector 222. In one aspect of this embodiment, sealing member 206 includes an end surface 220 that is sized and dimensioned to form a fluid seal with end section 223 of fuel injector 222. End surface 220 is a flat planar surface that abuts or contacts end section 223 of fuel injector 222. End section 223 likewise has a flat, planar surface that contacts, mates with or abuts end surface 220 of sealing member 204. Assembly 200 provides a metal to metal combustion seal with contact pressures high enough to yield sealing member 204 into sealing contact against an angled interior annular wall of bore 118 to form an angled and generally conical seal at sealing surface/interface 224. Accordingly, in one embodiment, injector mounting bore 118 and combustion shield 202 cooperate to form a sealing interface 224 that is positioned at an angle relative to needle 108 thereby creating a conical sealing surface. Sealing member 204 includes angled surface 226 that contacts sealing surface 224 when sealing member 204 is positioned longitudinally intermediate end section 223 of injector body 111 and the angled annular wall of bore 118. Hence, the contact between sealing member 204 and surface 226 forms a fluid seal. In one embodiment, angled sealing surface 226 and sealing interface 224 are each at an angle of about 44 degrees with respect to needle 108.

Much like sealing member 104, sealing member 204 is generally circular in shape and includes an interior ring diameter 216 formed by an annular interior ring wall portion and an angled exterior wall portion/surface 226. In one embodiment, sealing member 204 may be formed of a single unitary piece. Although in various alternative embodiments sealing member 204 may be formed of multiple pieces, a single unitary piece is easier to form and assemble as opposed to two or more pieces. In one embodiment, sealing member 204 may be formed of a stainless steel material, which may be an SAE 303 stainless steel. In addition, to the other benefits provided by sealing member 204, the material of sealing member 204 provides a thermal barrier to the combustion heat from an exemplary combustion chamber.

In one embodiment of the present disclosure, combustion shield 202 is a component that is fabricated distinctly or formed separately from sealing member 204. As shown in the illustrative embodiments of FIGS. 2-2B and FIG. 3, first section 210 generally has at least a first diameter 214 and second section 212 has a second diameter 218 that is smaller than first diameter 214. In one embodiment, combustion shield 202 may be formed of a single unitary piece. Although in various alternative embodiments combustion shield 202 may be formed of multiple pieces, a single unitary piece is easier to form and assemble as opposed to two or more pieces. In one embodiment, combustion shield 202 is a conical load carrying copper heat transfer shield. The conical design allows combustion shield 202 to be received and secured within bore 118 such that sealing member 204 may cooperate with injector 222 and the annular wall of bore 118 to form a robust fluid seal and carry the clamping load induced by injector 222. In one embodiment, second section 212 of combustion shield 202 may provide retention onto nozzle 106 via, for example, a press fit that also allows heat to leave the combustion chamber and move upwardly longitudinally toward low temperature section 132. During installation of assembly 200 and fuel injector 222 into bore 118, when nozzle 106 is positioned within second section 212 of combustion shield 202 an inner surface of second section 212 is directly adjacent to, mates with, abuts, or faces a peripheral outer surface of nozzle 106.

Figures 4, 4A:
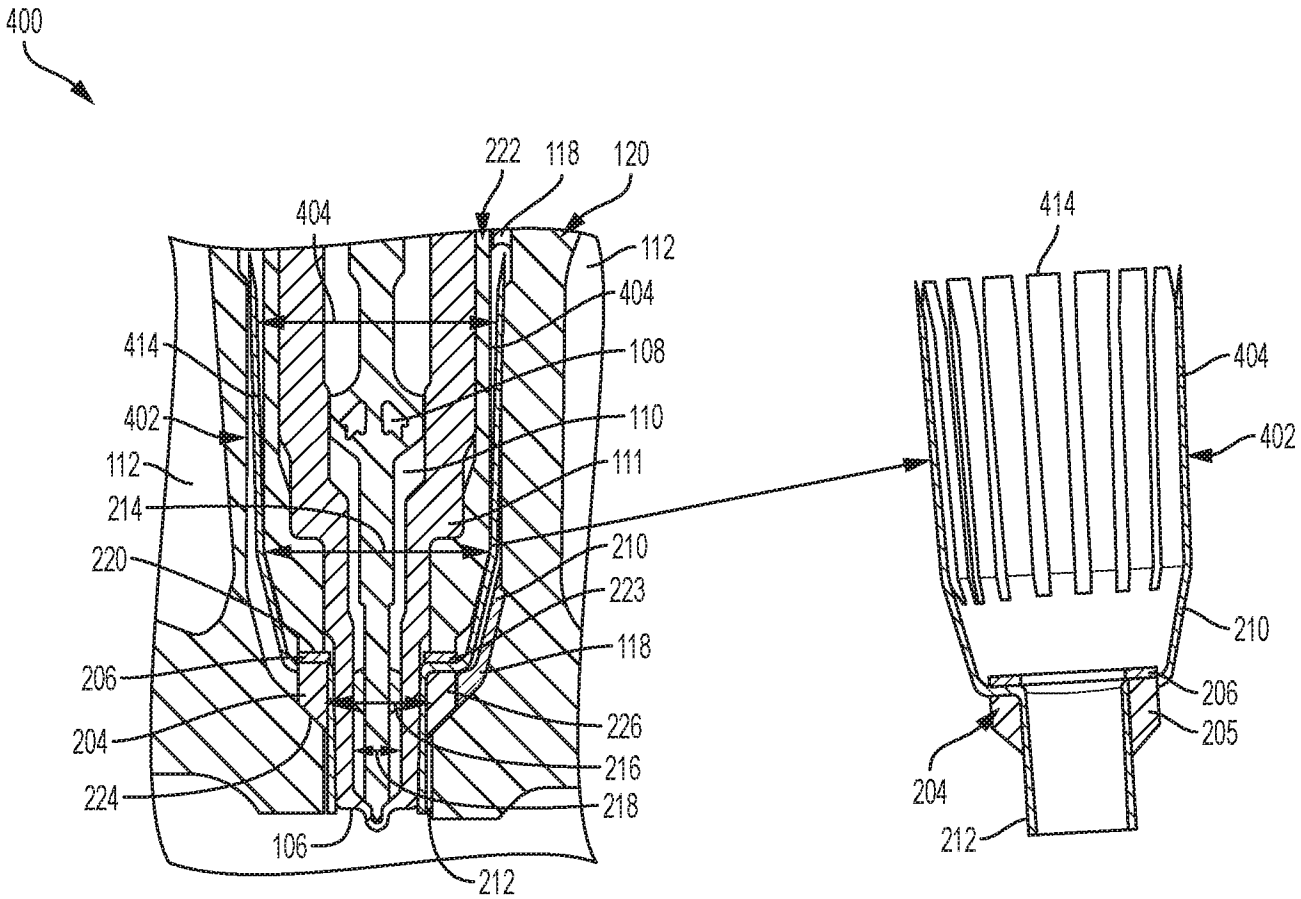
FIG. 4 shows a cross-sectional view of an injector combustion seal assembly according to an embodiment of the present disclosure.
FIG. 4A shows a cross-sectional view of a combustion shield of the injector combustion seal assembly of FIG. 4 according to an embodiment of the present disclosure.

In the illustrative embodiment of FIGS. 4 and 4A, injector combustion shield assembly 400 generally includes a combustion shield 402 comprising a fingers section 404 which includes a plurality of fingers 414. Combustion shield 402 and more particularly fingers section 404 has a length that is sufficiently long such that fingers 414 extend longitudinally upwardly within bore 118 to facilitate conduction of heat into a portion of bore 118 that is adjacent water jacket 112 of engine head 120. Combustion shield 402 is substantially the same as combustion shield 202 disclosed in the illustrative embodiment of FIGS. 2-2B, except that shield 402 includes fingers section 404. As generally discussed above in the disclosed embodiment of FIGS. 1 and 1A, the embodiment of FIGS. 4 and 4A also includes plurality of fingers 414 that are structured to contact an exemplary cast iron cylinder head which includes one or more fluid channels that form fluid/water jacket 112. In various embodiments of the present disclosure, fluid water jacket 112 may contain cooled fluid, water or low pressure fuel flowing throughout. Hence, combustion shield 402 is generally structured to conduct heat from and/or adjacent to nozzle 106 longitudinally upwardly toward fingers 414 and ultimately toward the sections of bore 118 that are adjacent to or in closest proximity to fluid jacket 112.

Figure 5B:
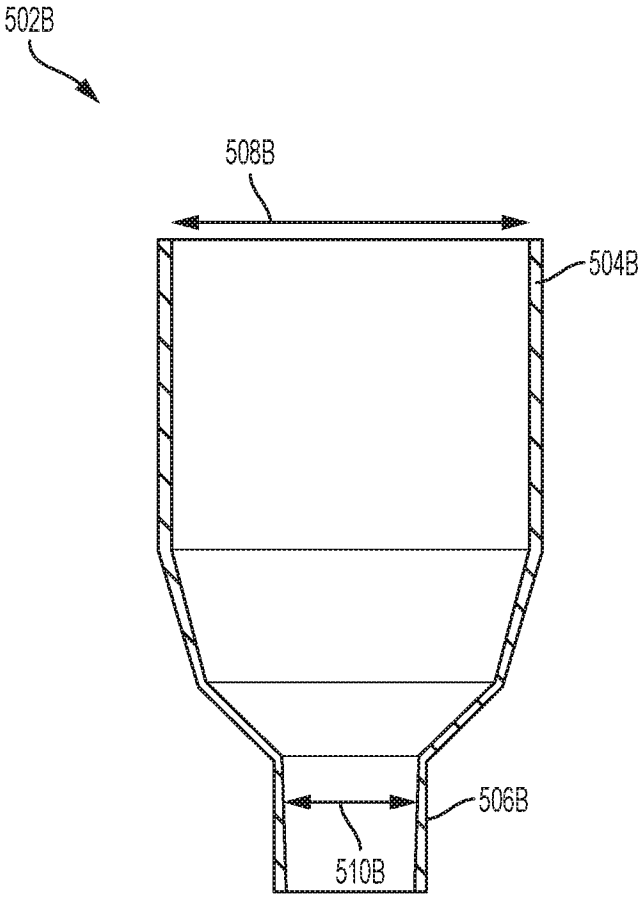
FIGS. 5A and 5B show cross-sectional views of injector combustion shields according to an embodiment of the present disclosure.
Figure 5A:
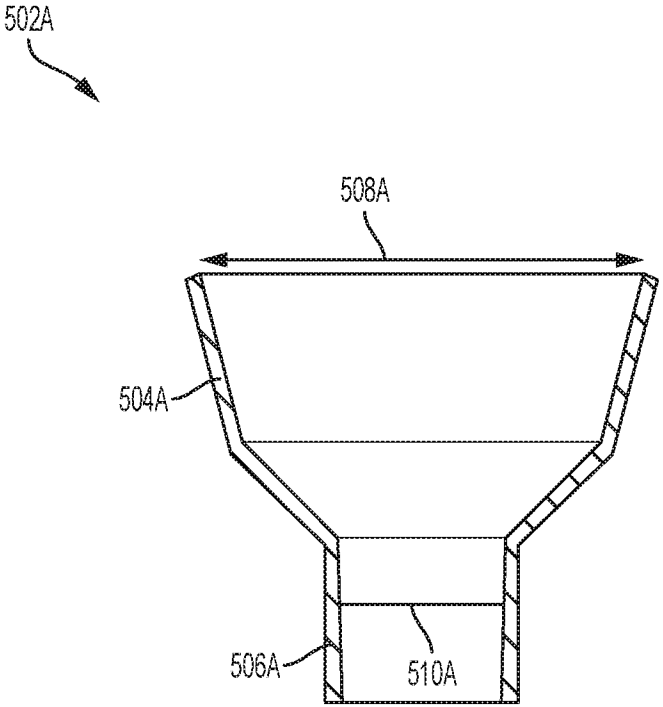

Referring now to the illustrative embodiment of FIGS. 5A and 5B, cross-sectional views of representative injector combustion shields according to an embodiment of the present disclosure are shown. Combustion shield 502A and 502B respectively include first sections 504A/504B, second sections 506A/506B, first diameter 508A/508B and second diameter 510A/510B wherein first diameter 508A/508B is greater than second diameter 510A/510B. In one embodiment, shields 502A/502B provide substantially the same functions regarding fuel injector nozzle tip temperature reduction as disclosed above with respect to combustion shield 102, shield 202, and shield 402. As such, and by way of example, in one or more embodiments of the present disclosure, combustion shield 502A or combustion shield 502B may generally be installed in assembly 100 in place of combustion shield 102.

Figure 6:
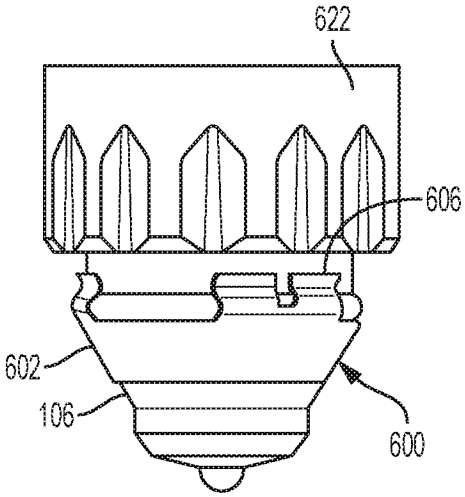
FIG. 6 shows a perspective view of an injector combustion shield according to an embodiment of the present disclosure.
Figure 6B:
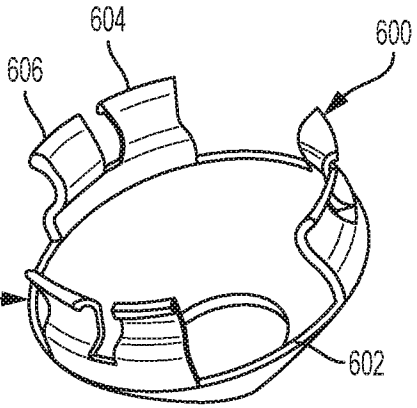
FIG. 6B shows a perspective view of the injector combustion shield of FIG. 6 according to an embodiment of the present disclosure.
Figure 6A:
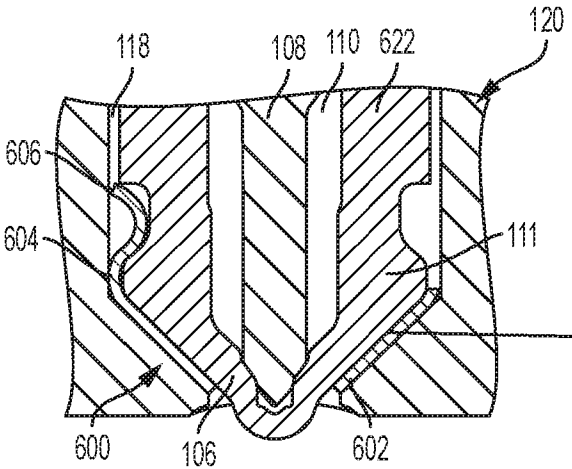
FIG. 6A shows a cross-sectional view of the injector combustion shield of FIG. 6 FIG. 6 according to an embodiment of the present disclosure.
Figures 7, 7A, 7B, 7C:
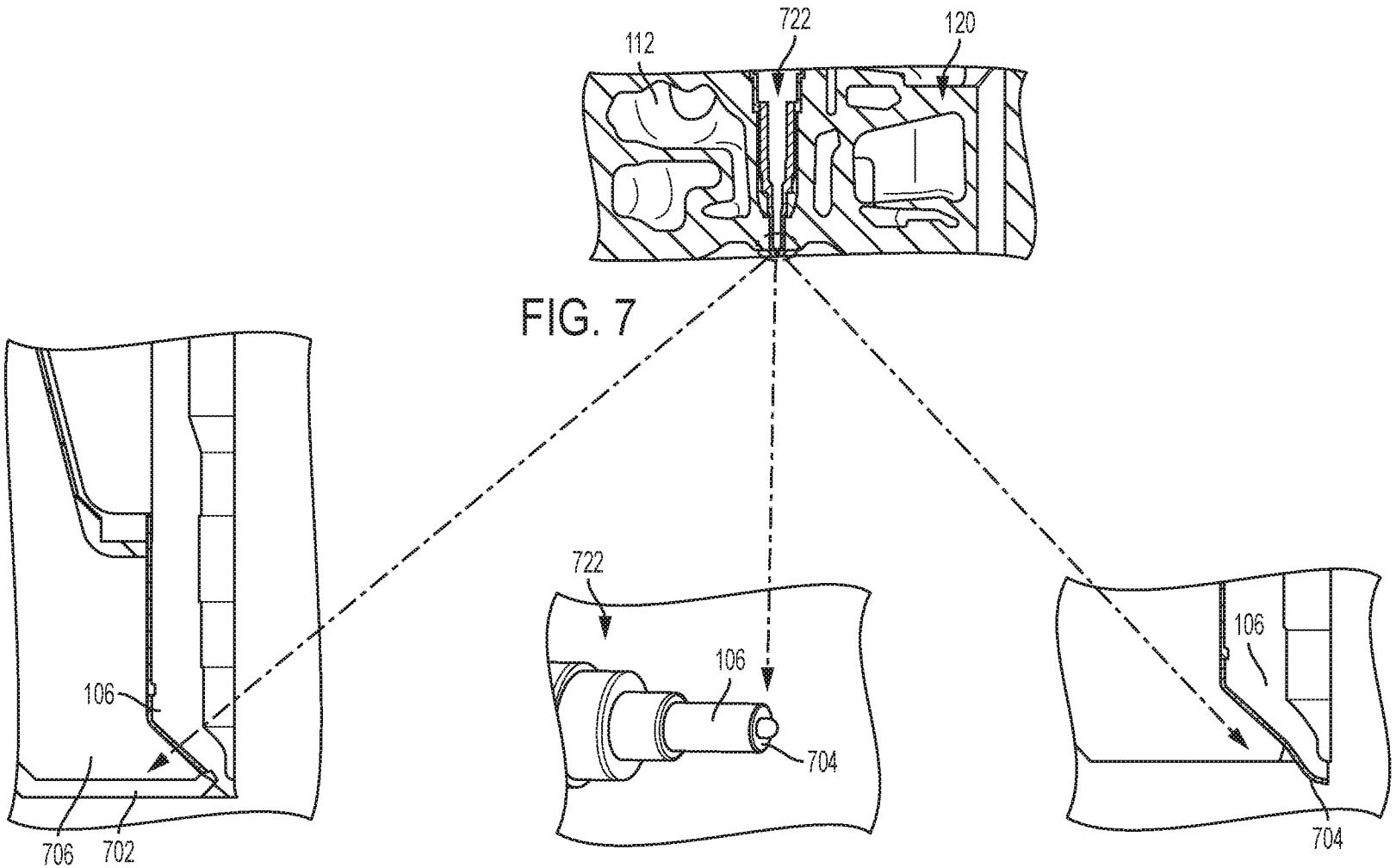
FIG. 7 shows a cross-sectional view of a fuel injector nozzle and engine head according to an embodiment of the present disclosure.
FIG. 7A shows an enlarged cross-sectional view of a portion of the fuel injector nozzle and engine head of FIG. 7 including an applied thermal barrier coating according to an embodiment of the present disclosure.
FIG. 7B shows an enlarged cross-sectional view of a portion of the fuel injector nozzle and engine head of FIG. 7 according to an embodiment of the present disclosure.
FIG. 7C shows a perspective view of the nozzle of the fuel injector of FIG. 7 including a thermal barrier coating according to an embodiment of the present disclosure.

FIGS. 6, 6A, and 6B show cross-sectional and perspective views of an injector combustion shield according to an embodiment of the present disclosure. Combustion shield 600 includes first section 602 and second section 604. Second section 604 includes a plurality of spring clips or fingers 606 structured to contact an exterior surface of an exemplary nozzle 106 of an exemplary fuel injector 622. In one embodiment, spring clips 606 causes combustion shield 600 to be securely affixed to the exterior surface of nozzle 106. In the illustrative embodiment of FIGS. 6, 6A, and 6B, spring clips 606 generally include a curved portion that is structured to provide a spring or clamping force that facilitates affixing shield 600 to nozzle 106. In one embodiment, shield 600 may also be described as a lower injector seal that seals certain areas of injector 622 from heated combustion gases that may enter injector receiving bore 118 during combustion of atomized fuel injected into an exemplary cylinder (not shown) by injector 622. Hence, use of shield/seal 600 results in only the tip of injector nozzle 106 being exposed to an exemplary combustion chamber which helps to mitigate damage to injector 622 due to excessive heat from hot combustion gases. In one embodiment, shield/seal 600 allows for a reduced clamping load to be applied to fuel injector 622 when injector 622 is installed within receiving bore 118. As is known by one of ordinary skill in the art, high or excessive clamping loads on fuel injectors can cause damage to, or distortion of, one or more parts and components associated with the injector.

FIGS. 7 and 7A-7C show a perspective view of a fuel injector nozzle including an applied thermal barrier and enlarged cross-sectional views of the fuel injector nozzle and engine head including the applied thermal barrier coating according to an embodiment of the present disclosure. The illustrative embodiment of FIGS. 7 and 7A-7C generally includes thermal barrier coating 702 applied to an area of an exemplary cylinder head 706 of engine head 120. In one embodiment, the area to which coating is applied is directly adjacent to and/or immediately surrounding the tip of injector nozzle 106 of fuel injector 722. The embodiment of FIGS. 7 and 7A-7C further includes thermal barrier coating 704 applied directly to the tip of nozzle 106 and/or to other areas of nozzle 106 that are adjacent to or surrounding the tip. In one embodiment, thermal barrier coating 702 and coating 704 are each Plasma Spray Zirconia (PSZ) coatings that provide thermal management of fuel injector tip and nozzle temperatures by reducing temperatures experienced by the injector tip/nozzle during combustion of fuel in a combustion chamber of an internal combustion engine. In one embodiment, use of PSZ coating 702 and PSZ coating 704 either alone or in combination may result in a reduced injector tip/nozzle temperature of at least approximately 30-50 degrees Celsius when exposed to hot combustion gases. In one embodiment, a material including PSZ coating properties generally includes a sol gel material. In yet another embodiment, coating 702 and coating 704 have an applied thickness of approximately 200 microns wherein applied thickness of the coatings may be increased or decreased based on differing fuel injector tip geometries. In one embodiment, exemplary methods of applying coating 704 includes masking the holes of injector nozzle 106 prior to coating or coating nozzle 106 and then blowing off unwanted coating from inside injector 722 prior to the coating being solidified.

Figure 8:
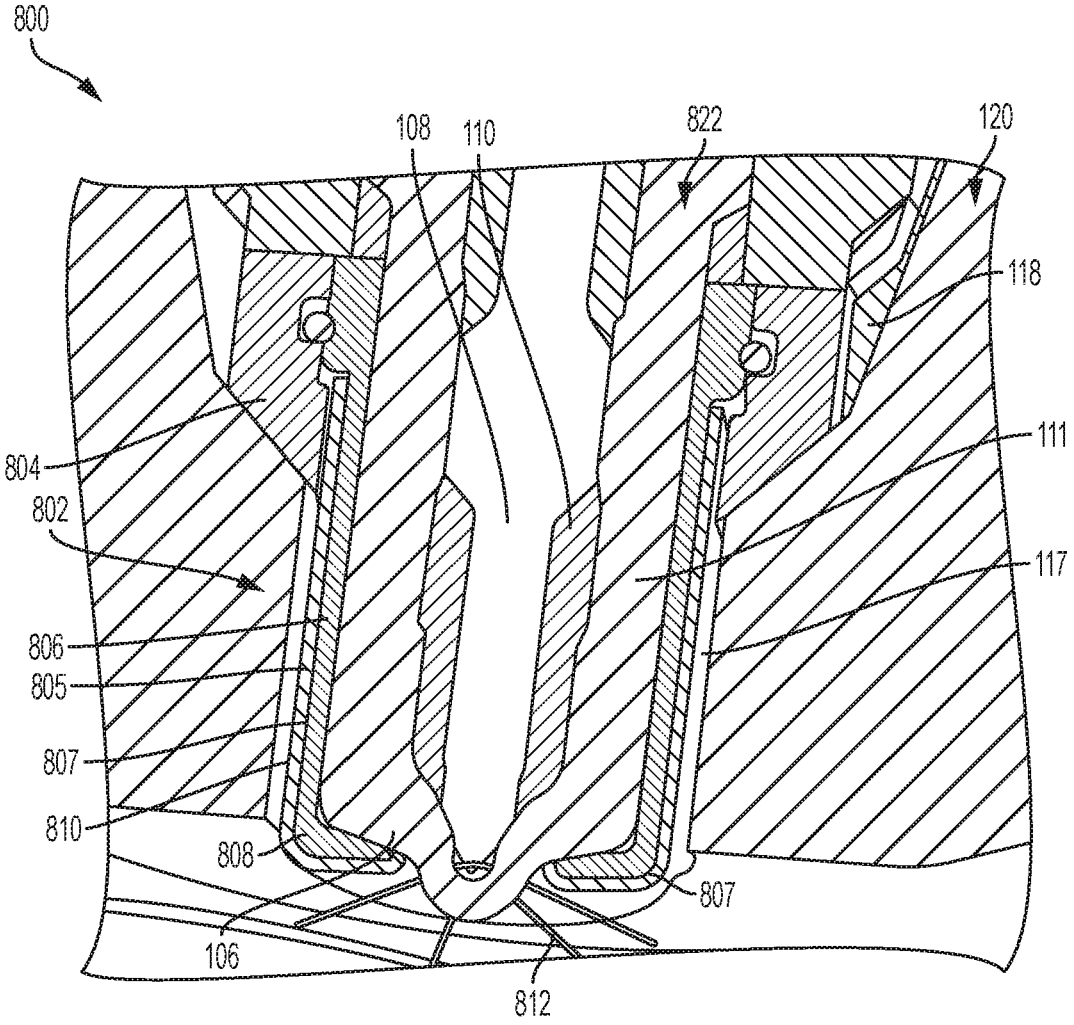
FIG. 8 shows a cross-sectional view of another fuel injector combustion seal assembly according to the present disclosure.

FIG. 8 shows a cross-sectional view of another fuel injector combustion seal assembly (hereinafter "assembly 800") according to the present disclosure. In the illustrative embodiment of FIG. 8, descriptions of assembly 800 may include one or more elements being identical to or having substantial similarity with elements previously described in other illustrative embodiments of the present disclosure. These identical or substantially similar elements will be numbered the same through various embodiments of the present disclosure. As such, to the extent that additional descriptions are not provided, reference should be made to the above mentioned description of any elements of the embodiment of FIG. 8 that are the same as or substantially similar to elements disclosed above. In the illustrative embodiment of FIG. 8, assembly 800 generally includes combustion shield 802, sealing member 804, and thermal barrier coating 805. In one embodiment, coating 805 has a thickness of 0.5 millimeters (mm) and includes substantially the same material properties as coating 702 disclosed above in the embodiment of FIG. 7. In one embodiment, shield 802 generally includes a first portion/section 806 and a second portion/section 808. In this embodiment, shield 802 is an annular shield and first portion 806 is disposed annularly around an exterior annular wall of nozzle 106 such that first portion 806 contacts the annular wall. Second portion 808 provides a wrap-around or overlapping feature whereby second portion 808 wraps around the end or tip of nozzle 106. In one embodiment, shield 802 is press-fit over nozzle 106. By way of first portion 806 and second portion 808, shield 802 substantially overlaps the tip of injector 822 and therefore facilitates a substantial transfer of heat from nozzle 106 toward cooler portions of injector bore 118 during combustion of fuel 812.

As shown in the illustrative embodiment of FIG. 8, shield 802 may include thermal barrier coating 805. In one embodiment, bore 118 may also include a nozzle receiving bore 117 structured for receiving nozzle 106 of fuel injector 822. Receiving bore 117 also includes an annular wall 810. When coating 805 is applied to an exterior surface of shield 802 and when nozzle 106 is positioned in receiving bore 117, coating 805 may be adjacent to and/or in close proximity with annular wall 810. In various embodiments of the present disclosure, coating 805 is much like coating 702 discussed above in the embodiment of FIG. 7. Hence, when applied to the exterior surface of shield 802, coating 805 cooperates with shield 802 to provide thermal management of fuel injector tip and nozzle 106 temperatures by reducing temperatures experienced by the injector tip/nozzle during combustion of fuel 812. In one embodiment, first portion 806 and second portion 808 include an exterior wall 807 and coating 805 is generally applied to exterior annular wall 807. In one embodiment, shield 802 is designed for installation onto an exemplary fuel injector 822 to effectively facilitate injector tip/nozzle cooling without obstructing the injector tip so that fuel 812 may be freely injected in the cylinder of an exemplary internal combustion engine.

Assembly 800 provides the ability to keep the temperature of fuel injector nozzle 106 below a critical limit or threshold temperature required to substantially prevent or mitigate the formation of carbon deposits on, for example, the tip or fuel outlet orifices of fuel injector 822. As is generally known in the art, carbon deposits on fuel injector 822 will likely affect the performance and emissions profile of an exemplary internal combustion engine in which injector 822 is installed. For dual fuel engines that utilize a combination of diesel fuel and natural gas fuel to facilitate combustion, a high percentage of natural gas and a lower or reduced percentage of diesel fuel is a desirable and cost effective method of operating these types of dual fuel engines. However, a reduction in the percentage of diesel fuel also increases the injector tip and nozzle temperatures experienced by injector 822 during combustion of fuel 812. Assembly 800 allows fuel flow through the diesel fuel injector to be significantly reduced when operating on a high level of natural gas. This reduction of the internal diesel fuel flow is enabled because of the substantial injector tip cooling and temperature reductions afforded by use of assembly 800. Thus, assembly 800 is an enabler for higher levels of natural gas substitution rate for the above mentioned dual fuel engines. Higher levels of substitution of a lower cost fuel (e.g. natural gas) will result in lower total cost of ownership for vehicle owners.

Figure 9:
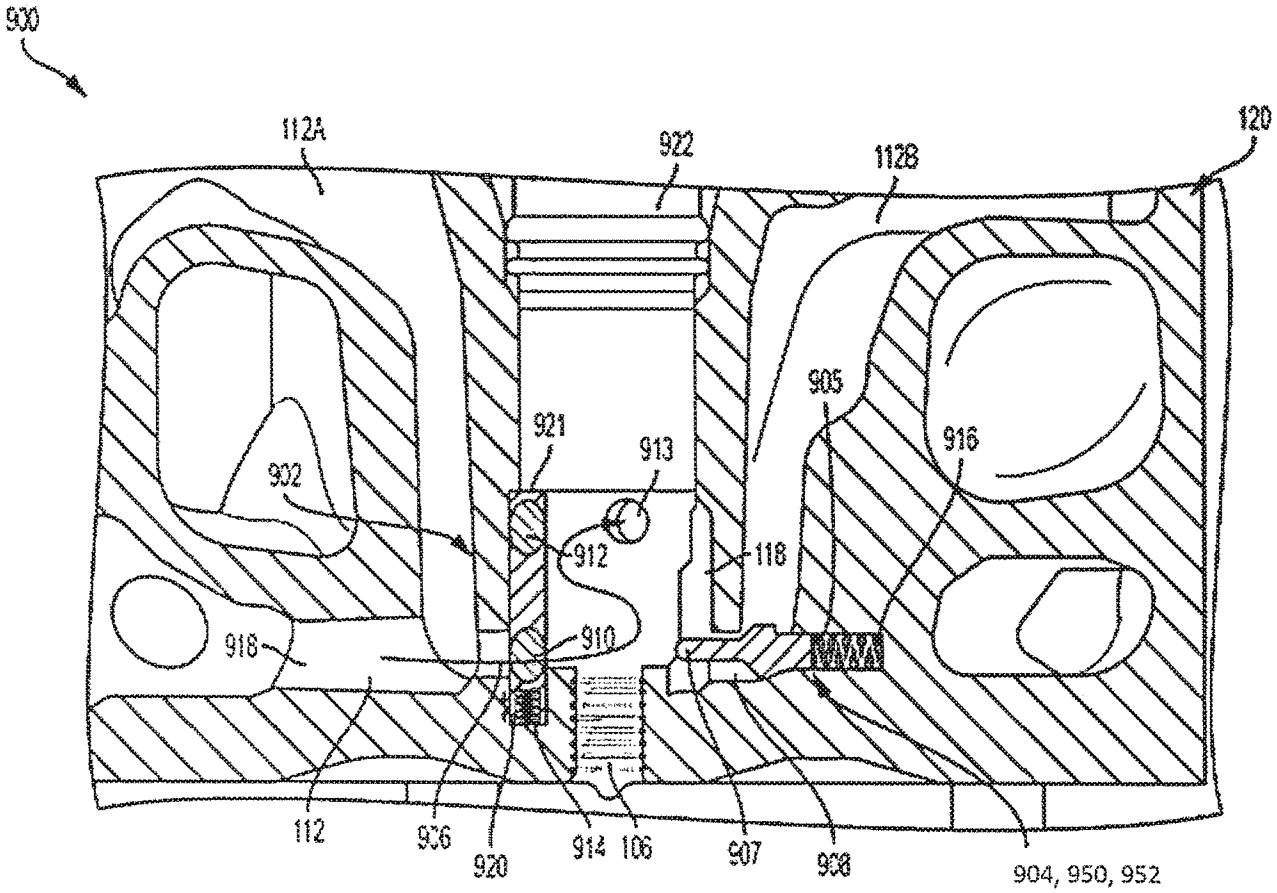
FIG. 9 shows a cross-sectional view of a fuel injector heat transfer assembly according to the present disclosure.

FIG. 9 shows a cross-sectional view of a fuel injector heat transfer assembly (hereinafter "assembly 900") according to the present disclosure. Assembly 900 generally includes fuel injector 922, first valve member 902, second valve member 904, first fluid opening 906 and second fluid opening 908, and fluid outlet port 913. Valve member 902 includes fluid inlet port 910, through-hole 912 and spring 914. As described in more detail in the disclosed embodiment of FIG. 11, valve member 902 includes an opened position and a closed position. When valve member 902 is in the opened position, fluid inlet port 910 aligns within fluid opening 906 and through-hole 912 aligns with fluid outlet port 913 so that fluid jacket 112A is in fluid communication with fluid opening 906, inlet port 910, injector receiving bore 118, fluid opening 908 and fluid outlet port 913. In one embodiment, fluid outlet port 913 is disposed within an annular wall of bore 118 and provides an outlet flow path to a low pressure coolant/fluid circuit that is distinct from an exemplary high pressure fluid circuit such as fluid jacket 112A and 112B. In one embodiment, when valve 902 is in the opened position fluid within fluid jacket 112A flows generally toward fluid opening 906, into bore 118, through fluid outlet port 913 and toward/through fluid opening 908. In one embodiment, assembly 900 includes only valve member 902 and does not include valve member 904 and fluid opening 908. In this embodiment, when valve 902 is in the opened position fluid within fluid jacket 112A flows generally toward fluid opening 906, into bore 118 and through fluid outlet port 913.

In one embodiment, valve member 902 includes a first end 920 in contact with spring 914 and a second end 921 in contact with a section of fuel injector 922. In the illustrative embodiment of FIG. 9, spring 914 provides a longitudinally upwardly biasing spring force which functions to bias valve member 902 toward the closed position. Valve member 902 is generally in the closed position when fuel injector 922 is not installed in injector receiving bore 118. In one embodiment, valve member 902 moves toward the opened position in response to fuel injector 922 being inserted or installed within bore 118. Upon installation within bore 118 a section of injector 922 contacts second end 921 of valve member 902 and the installation force of injector 922 overcomes the upwardly biasing spring force of spring 914 and causes valve member 902 to move toward the opened position. As noted above, when valve member 902 is in the opened position, fluid jacket 112A is in fluid communication with bore 118 and when valve member 902 is in the closed position fluid jacket 112A is not in fluid communication with bore 118.

In one embodiment, valve member 904 also includes an opened position and a closed position as well as a first end 905 and a second end 907. Likewise, when valve member 904 is in the opened position, fluid jacket 112B is in fluid communication with fluid opening 908, inlet port 910, injector receiving bore 118, fluid opening 906 and fluid outlet port 913. In one embodiment, when valve 904 is in the opened position fluid within fluid jacket 112B flows generally toward fluid opening 908, into bore 118, toward/through fluid outlet port 913 and through fluid opening 906. In one embodiment, assembly 900 includes valve member 904 and valve member 902 but does not include fluid opening 906. In this embodiment, when valve member 904 is in the opened position fluid within fluid jacket 112B flows generally toward fluid opening 908, into bore 118 and through fluid outlet port 913.

In one embodiment, valve member 904 includes first end 905 in contact with spring 916 and a second end 907 in contact with a section of fuel injector 922. In the illustrative embodiment of FIG. 9, spring 916 provides a laterally biasing spring force which functions to bias valve member 904 toward the closed position. Valve member 904 is generally in the closed position when fuel injector 922 is not installed in injector receiving bore 118. In one embodiment, valve member 904 moves toward the opened position in response to fuel injector 922 being inserted or installed within bore 118. Upon installation within bore 118 a section of injector 922 contacts second end 907 of valve member 904 and the installation force of injector 922 overcomes the biasing spring force of spring 914 and causes valve member 904 to move toward the opened position. As noted above, when valve member 904 is in the opened position, fluid jacket 112B is in fluid communication with bore 118 and when valve member 904 is in the closed position fluid jacket 112B is not in fluid communication with bore 118.

In an alternate embodiment, valve member 904 may include a sliding sleeve 950 or a poppet valve 952.

Assembly 900 essentially shuts off fluid or coolant from entering injector receiving bore 118 and the combustion cylinder of an internal combustion engine when injector 922 is removed. Thus, assembly 900 provides functionality which opens and closes a fluid or coolant passage within an exemplary injector receiving bore so as to reduce the temperature of fuel injector nozzle 106 and to aid in the reduction of carbon deposits build-up on the tip or nozzle 106. Additionally, in the disclosed embodiment, assembly 900 allows fluid or coolant to directly contact injector 922 without causing excessive damage to injector 922 or the cylinder and associated engine in which injector 922 is installed. Moreover, allowing fluid or coolant to be in direct contact with injector 922 reduces the amount of material between the critical areas of injector 922 and the cylinder head and the fluid or coolant. Hence, when fluid or coolant is closer to these critical areas the temperature surrounding nozzle 106 and injector 922 can be reduced which substantially mitigates the likelihood of carbon deposit formation on nozzle 106.

Figure 10:
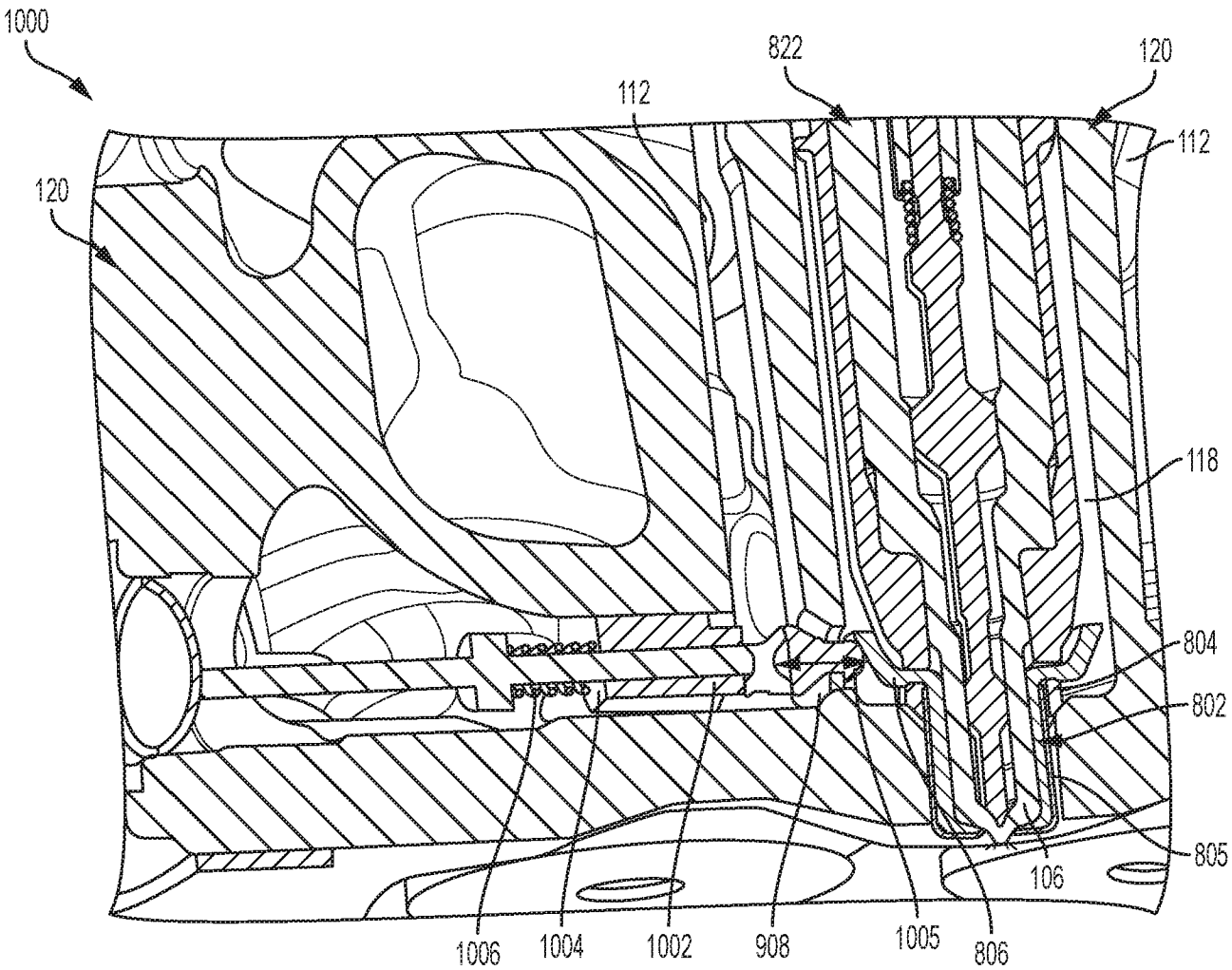
FIG. 10 shows a cross-sectional view of another fuel injector heat transfer assembly according to the present disclosure.

FIG. 10 shows a cross-sectional view of another fuel injector heat transfer assembly (hereinafter "assembly 1000") according to the present disclosure. Assembly 1000 generally includes fuel injector 822, valve member 1002, fluid opening 908 and fluid outlet port 913 (not shown). Generally, valve member 1002 functions substantially the same as valve member 904 and includes an opened position and a closed position. When valve member 1002 is in the opened position fluid within fluid jacket 112 flows generally toward fluid opening 908, into bore 118, and toward/through fluid outlet port 913. As shown in the illustrative embodiment of FIGS. 11, 11A, and 11B, bore 118 may include a fluid outlet port 913 that provides a flow path for fluid to exit bore 118 after flowing into bore 118 by way of fluid opening 908. Valve member 1002 includes a first end 1004 and a second end 1005. In one embodiment, valve member 1002 includes first end 1004 in contact with spring 1006 and a second end 1005 in contact with first section 806 of combustion shield 802. In the illustrative embodiment of FIG. 10, spring 1006 provides a laterally biasing spring force which functions to bias valve member 1002 toward the closed position. Valve member 1002 is generally in the closed position when fuel injector 822 and combustion shield 802 are not installed in injector receiving bore 118. In one embodiment, valve member 1002 moves toward the opened position in response to fuel injector 822 and combustion shield 802 being inserted or installed within bore 118. Thus, upon installation within bore 118, first section 806 of combustion shield 802 contacts second end 1005 of valve member 1002 and the installation force of injector 822 overcomes the biasing spring force of spring 1006 and causes valve member 1002 to move toward the opened position.

In the illustrative embodiment of FIG. 9 and FIG. 10, the exemplary fuel injector or combustion shield functions as a valve actuator for an exemplary valve member, whereby contact with a section of the injector (FIG. 9) or contact with a section of the combustion shield (FIG. 10) causes the valve member to move from the closed position to the opened position. In an alternative embodiment of the present disclosure valve members 902, 904, and 1002 may be pressure actuated such that high pressure fluid flowing within fluid jacket 112A and/or 112B causes actuation of the valve members. For example, in the disclosed embodiment of FIG. 10, a build-up of fluid pressure may occur at a location generally adjacent to second end 1005. When the pressure exceeds a threshold pressure, valve member 1002 moves to the opened position and when the pressure falls below the threshold pressure, the biasing lateral spring force of spring 1006 causes valve member 1002 to move toward the closed position. Various alternative valve member actuation methods may be utilized such as external valve member actuation that occurs independent of the fuel injector and flow of high pressure fluid. Additionally, in one embodiment, valve members 902, 904, and 1002 may be actuated based on a manual or mechanical actuation device.

Figure 11:
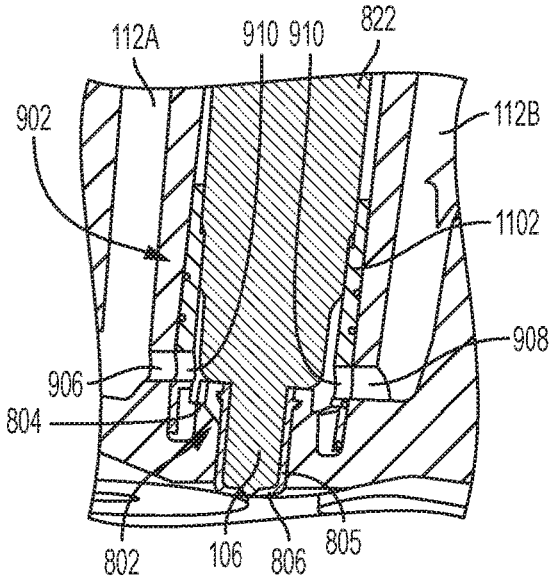
FIG. 11 shows a cross-sectional view of the valve member of the embodiment of FIG. 9.
Figure 11A:
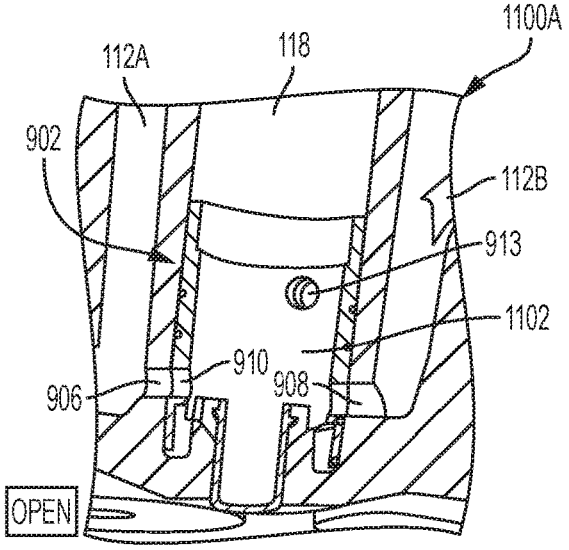
FIG. 11A shows a perspective view of the fuel injector heat transfer assembly of FIG. 9 in an opened position according to the present disclosure.
Figure 11B:
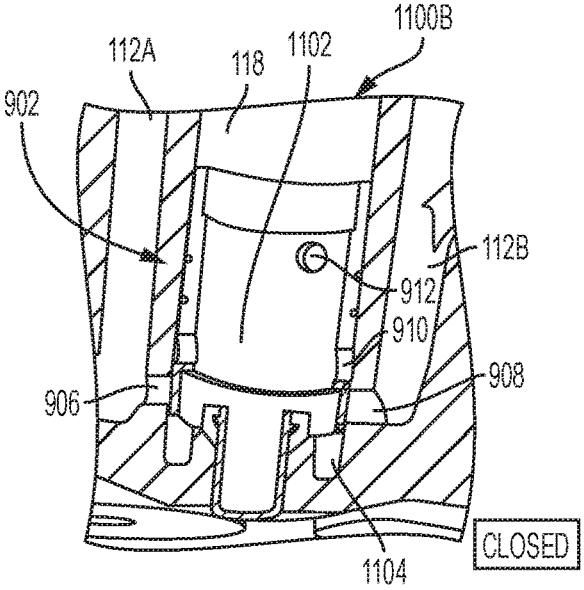
FIG. 11B shows a perspective view of the fuel injector heat transfer assembly of FIG. 9 in an opened position according to the present disclosure.

FIG. 11 shows a cross-sectional view of valve member 902. As noted above, valve member 902 generally includes fluid inlet ports 910, through-hole 912, and sleeve portion 1102 wherein through-hole 912 is generally disposed within sleeve portion 1102. As shown in the illustrative embodiment of FIGS. 11, 11A, and 11B, valve member 902 has an opened position 1100A (FIG. 11A) and a closed position 1100B (FIG. 11B). Upon installation within bore 118 and when valve member 902 is in the opened position 1100A, fluid inlet ports 910 are aligned with fluid opening 906 and 908 so that coolant/fluid within fluid jacket 112A or 112B can flow into bore 118. Likewise, when valve member 902 is in the opened position 1100A, through-hole 912 is aligned with fluid outlet port 913 so that coolant/fluid that entered bore 118 exits bore 118 via through-hole 912 and fuel outlet 913. In one embodiment, fluid outlet port 913 is disposed within an annular wall of bore 118 and provides an outlet flow path to a low pressure coolant/fluid circuit that is distinct from an exemplary high pressure fluid circuit such as fluid jacket 112A and 112B. When valve member 902 is in the closed position 1100B, fluid inlet ports 910 are not aligned with fluid opening 906 and 908 and through-hole 912 is not aligned with fluid outlet port 913 so that coolant/fluid within fluid jacket 112A/B cannot flow into bore 118. In one embodiment, and as disclosed above, valve member 902 may include a spring disposed in location 1104. The spring may be structured to apply a longitudinally upwardly biasing spring force unto one end of sleeve portion 1102 to cause valve member 902 to move/actuate toward the closed position.

Figure 12:
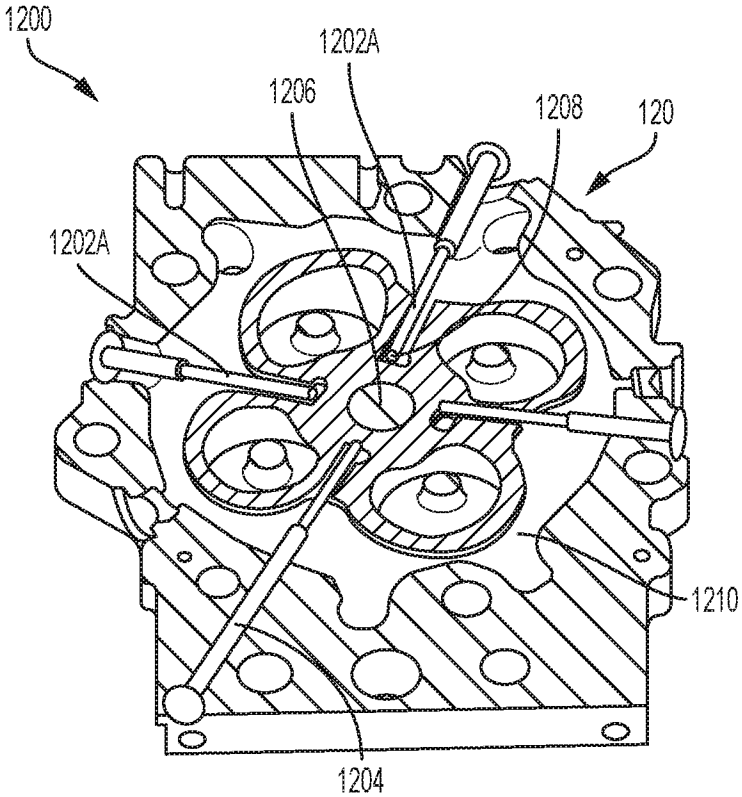
FIG. 12 shows a cross-sectional view of yet another fuel injector heat transfer assembly according to the present disclosure.

FIG. 12 shows a cross-sectional view of yet another fuel injector heat transfer assembly (hereinafter "assembly 1200") according to the present disclosure. Assembly 1200 generally includes engine head 120, heat pipes 1202A, drill plugs 1204, injector receiving bore 1206, and fluid/coolant 1210. In one embodiment, assembly 1200 includes four heat pipes 1202A held in place by fluid/coolant drilling plugs 1204. As shown in the illustrative embodiment of FIG. 12, when four heat pipes 1202A are used, two pipes may be arranged in a longitudinally vertical configuration relative to injector receiving bore 1206 so that a first end 1208 of the pipes is adjacent injector bore 1206. Likewise, the two other pipes may be arranged in a laterally horizontal configuration relative to injector bore 1206 so that a first end 1208 of the pipes is adjacent injector bore 1206. Heat pipes 1202A transfer heat directly from injector bore 1206 to cooler portions of the engine head and thus facilitates removal of heat from critical areas of the cylinder head and fuel injector 822. In one embodiment, a section of heat pipes 1202A is disposed generally within fluid/coolant 1210 to facilitate the transfer of heat adjacent to bore 1206 toward cooler portions of engine head 120. In one embodiment, coolant/fluid 1210 is stationary and generally does not flow or move within the passages of engine head 120. Thus, use of assembly 1200 within an exemplary internal combustion engine mitigates the need for fluid transfer devices such as pumps and other fluid movement means. Accordingly, assembly 1200 reduces coolant/fluid flow requirements and minimizes the number of needed coolant/fluid passages and therefore improves the structure and/or structural integrity within exemplary engine cylinder heads. Moreover, assembly 1200 will allow for improved engine cylinder head designs which have higher strength, lower temperatures in response to fuel combustion, reduced fluid/coolant flow requirements, and reduced fuel injector temperatures in response to combustion which, as noted above, will enable higher dual fuel substitution rates comprising a higher percentage of natural gas and a substantially reduced percentage of diesel fuel.

Figure 13:
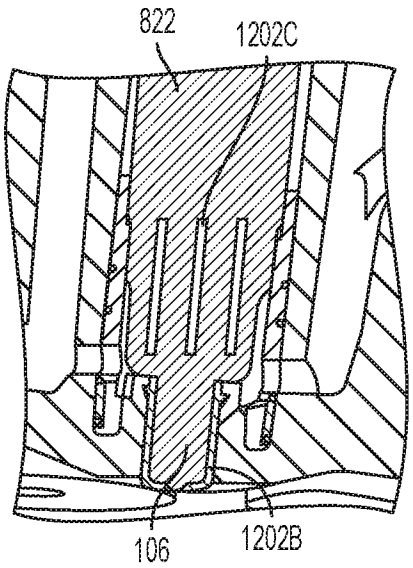
FIG. 13 shows a cross-sectional view of an exemplary heat pipe used in the fuel injector heat transfer assembly of FIG. 12.

In one embodiment, fuel injector 822 may include one or more heats pipes 1202 integrated within fuel injector 822. As shown in the illustrative embodiment of FIG. 13, heat pipes 1202B may be disposed generally within nozzle 106 and heat pipes 1202C may be disposed generally within a section of injector 822 that is longitudinally above nozzle 106. In one embodiment, combustion shield 802, discussed above in the embodiment of FIG. 8, may be replaced with one or more heat pipes 1202B disposed longitudinally generally along an outer surface of nozzle 106. Likewise, additional one or more heat pipes 1202C may be disposed longitudinally generally along an outer surface of the section of injector 822 that is above nozzle 106. In one embodiment, while utilizing assembly 1200 to facilitate heat transfer, during combustion of fuel from injector 822, heat generated within the combustion chamber will generally be wicked/transferred from nozzle 106, by way of heat pipes 1202B, toward heat pipes 1202C integrated within the upper portion of injector 822. In one embodiment, heat pipes 1202A may be generally aligned with and/or in close proximity to heat pipes 1202C such that heat transferred from heat pipes 1202B is ultimately received by heat pipes 1202A and absorbed by fluid/coolant 1210. As is known in the art, heat pipes 1202 generally include a heat pipe working fluid or coolant medium that is hermetically sealed within an exemplary fluid compartment within heat pipe 1202. The working fluid or coolant medium has a boiling point corresponding to the upper range of acceptable nozzle operating temperatures to transfer heat from nozzle 106 toward cooler portions of bore 1206, engine head 120, and toward fluid/coolant 1210 which operates as a heat sink.

Other mechanisms and approaches for reducing fuel injector nozzle tip temperature are generally described in co-pending U.S. Patent Application Publication No. 2015/0040857 A1 filed on Aug. 8, 2013, the entire disclosure of which being expressly incorporated herein by reference and co-pending U.S. Patent Application Publication No. 2013/0133603 A1 filed on Jul. 25, 2012, the entire disclosure of which being also expressly incorporated herein by reference.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

The invention claimed is:

1. A heat transfer assembly comprising:

a bore configured to receive a fuel injector, the bore including a first fluid opening in fluid communication with a first fluid jacket and a fluid outlet positioned within an annular wall of the bore; and a first valve positioned between the first fluid jacket and the first fluid opening and configured to selectively permit a fluid from the first fluid jacket to enter the bore, the first valve being movable between an open configuration to permit fluid flow from the first fluid jacket into the bore via the first fluid opening and a closed configuration to prevent fluid flow from the first fluid jacket into the bore;

wherein the first valve moves from the closed configuration to the open configuration in response to contact with a first section of the fuel injector.

2. The assembly of claim 1, wherein a first end of the first valve is in contact with a first spring providing a biasing force to bias the first valve toward the closed configuration.

3. The assembly of claim 2, wherein a force applied by the fuel injector to the first valve when the fuel injector is installed within the bore overcomes the biasing force of the first spring such that the first valve moves from the closed configuration to the open configuration.

4. The assembly of claim 1, wherein the fluid outlet is in fluid communication with a second fluid jacket.

5. A heat transfer assembly comprising:

a bore configured to receive a fuel injector, the bore including:

a first fluid opening in fluid communication with a first fluid jacket;

a second fluid opening in fluid communication with a second fluid jacket; and a fluid outlet positioned within an annular wall of the bore;

a first valve positioned between the first fluid jacket and the first fluid opening and configured to selectively permit fluid from the first fluid jacket to enter the bore;

a second valve positioned between the second fluid jacket and the second fluid opening configured to selectively permit fluid from the second fluid jacket to enter the bore, the second valve being movable between an open configuration to permit fluid flow from the second fluid jacket into the bore via the second fluid opening and a closed configuration to prevent fluid flow from the second fluid jacket into the bore;

wherein the second valve moves from the closed configuration to the open configuration in response to contact with a first section of the fuel injector.

6. The assembly of claim 5, wherein a first end of the first valve is in contact with a first spring providing a first biasing force to bias the first valve toward the closed configuration to prevent fluid flow from the first fluid jacket into the bore.

7. The assembly of claim 5, wherein a first end of the second valve is in contact with a second spring that provides a second biasing force to bias the second valve toward the closed configuration.

8. The assembly of claim 7, wherein a force applied by the fuel injector to the second valve overcomes the second biasing force of the second spring such that the second valve moves from the closed configuration to the open configuration.

9. The assembly of claim 2, wherein the first spring provides a lateral biasing force.

10. The assembly of claim 1, wherein the first valve includes a through-hole aligned with the fluid outlet when the valve is in the open configuration.

11. The assembly of claim 2, further including a second valve movable between an open configuration to permit fluid flow from a second fluid jacket into the bore via a second fluid opening of the bore and a closed configuration to prevent fluid flow from the second fluid jacket into the bore.

12. The assembly of claim 7, wherein the second spring provides a vertical biasing force to bias the valve toward the closed configuration.

13. The assembly of claim 5, wherein at least one of the first valve and the second valve includes a through-hole aligned with a fluid outlet positioned within an annular wall of the bore when the at least one of the first valve and the second valve is in the open configuration.

14. The assembly of claim 11, wherein a first end of the second valve is in contact with a second spring providing a biasing force to bias the second valve toward the closed configuration.

15. The assembly of claim 14, wherein the second spring provides a vertical biasing force.

16. The assembly of claim 11, wherein the second valve includes a through-hole aligned with the fluid outlet when the valve is in the open configuration.

17. The assembly of claim 11, wherein the second valve moves from the closed configuration to the open configuration in response to contact with a second section of the fuel injector.

18. The assembly of claim 6, wherein the first spring provides a lateral biasing force to bias the valve toward the closed configuration.

19. The assembly of claim 5, wherein the first valve moves from the closed configuration to the open configuration in response to contact with a second section of the fuel injector.

20. A method of transferring heat in an internal combustion engine, the method comprising:

placing a fuel injector within a bore;

contacting a first valve upon placement of the fuel injector, wherein the first valve is positioned between a first fluid jacket and a first fluid opening configured to selectively permit a fluid from the first fluid jacket to enter the bore, the first valve being moveable between an open configuration and a closed configuration, wherein the open configuration permits fluid flow from the first fluid jacket into the bore via the first fluid opening and the closed configuration prevents fluid flow from the first fluid jacket into the bore;

opening the first valve upon contact with a first section of the fuel injector.

21. The method of claim 20, wherein a first end of the first valve is in contact with a first spring providing a first biasing force to bias the first valve toward the closed configuration.

22. The method of claim 21, wherein a force applied by the fuel injector to the first valve overcomes the first biasing force of the first spring such that the first valve moves from the closed configuration to the open configuration.

23. The method of claim 21, wherein the first spring provides a lateral first biasing force.

24. The method of claim 20, further comprising:

contacting a second valve upon placement of the fuel injector, wherein the second valve is positioned between a second fluid jacket and a second fluid opening configured to selectively permit a fluid from the second fluid jacket to enter the bore, the second valve being moveable between an open configuration and a closed configuration, wherein the open configuration permits fluid flow from the second fluid jacket into the bore via the second fluid opening and the closed configuration prevents fluid flow from the second fluid jacket into the bore;

opening the second valve upon contact with a second section of the fuel injector.

25. The method of claim 24, wherein a first end of the second valve is in contact with a second spring providing a second biasing force to bias the second valve toward the closed configuration.

26. The method of claim 25, wherein a force applied by the fuel injector to the second valve overcomes the second biasing force of the second spring such that the second valve moves from the closed configuration to the open configuration.

27. The method of claim 25, wherein the second spring provides a vertical second biasing force.

28. A heat transfer assembly comprising:

a fuel injector comprising a nozzle;

a nozzle combustion shield configured to couple to the nozzle of the fuel injector; a bore configured to receive the fuel injector, the bore including a fluid opening in fluid communication with a fluid jacket and a fluid outlet positioned within an annular wall of the bore; and a valve positioned between the fluid jacket and the fluid opening and configured to selectively permit a fluid from the fluid jacket to enter the bore, the valve being movable between an open configuration to permit fluid flow from the fluid jacket into the bore via the fluid opening and a closed configuration to prevent fluid flow from the fluid jacket into the bore;

wherein the valve moves from the closed configuration to the open configuration in response to contact with a section of the nozzle combustion shield.

29. The assembly of claim 28, wherein a first end of the valve is in contact with a spring providing a biasing force to bias the valve toward the closed configuration.

30. The assembly of claim 29, wherein a force applied by the fuel injector via the nozzle combustion shield to the valve when the fuel injector is installed within the bore overcomes the biasing force of the spring such that the valve moves from the closed configuration to the open configuration.

31. The assembly of claim 29, wherein the spring provides a lateral biasing force.

32. The assembly of claim 28, wherein the valve includes a through-hole aligned with the fluid outlet when the valve is in the open configuration.

33. A method of transferring heat in a n internal combustion engine, the method comprising:

placing a fuel injector within a bore, the fuel injector comprising a nozzle and including a nozzle combustion shield configured to couple to the nozzle of the fuel injector;

contacting a valve upon placement of the fuel injector, wherein the valve is positioned between a fluid jacket and a fluid opening configured to selectively permit a fluid from the fluid jacket to enter the bore, the valve being moveable between an open configuration and a closed configuration, wherein the open configuration permits fluid flow from the fluid jacket into the bore via the fluid opening and the closed configuration prevents fluid flow from the first fluid jacket into the bore;

opening the first valve upon contact with a section of the nozzle combustion shield.

34. The method of claim 33, wherein a first end of the valve is in contact with a spring providing a biasing force to bias the valve toward the closed configuration.

35. The method of claim 34, wherein a force applied by the fuel injector to the valve via the nozzle combustion shield overcomes the biasing force of the spring such that the valve moves from the closed configuration to the open configuration.

36. The method of claim 34, wherein the spring provides a lateral biasing force.

* * * * *